US009306357B2

(12) United States Patent
Lee

(10) Patent No.: US 9,306,357 B2
(45) **Date of Patent: *Apr. 5, 2016**

(54) ELECTRICAL POWER CONNECTOR PREPARATION METHOD

(71) Applicant: RIIDEA International Corp., Apia (WS)

(72) Inventor: Lung-Hsi Lee, New Taipei (TW)

(73) Assignee: RIIDEA INTERNATIONAL CORP., Apia (WS)

( * ) Notice: Subject to any disclaimer, the term of this patent is extended or adjusted under 35 U.S.C. 154(b) by 188 days.

This patent is subject to a terminal disclaimer.

(21) Appl. No.: 13/905,612

(22) Filed: May 30, 2013

(65) Prior Publication Data

US 2014/0352145 A1 Dec. 4, 2014

(51) Int. Cl.
*H01R 43/16* (2006.01)
*H01R 43/24* (2006.01)

(52) U.S. Cl.
CPC ..... *H01R 43/16* (2013.01); *H01R 43/24* (2013.01); *Y10T 29/49208* (2015.01)

(58) Field of Classification Search
CPC ..... H01R 43/16; H01R 43/24; H01R 43/28; H01R 24/28; H01R 2103/00; Y10T 29/49176; Y10T 29/49217
See application file for complete search history.

(56) References Cited

FOREIGN PATENT DOCUMENTS

CN 102290661 A * 12/2011

* cited by examiner

*Primary Examiner* — Paul D Kim
(74) *Attorney, Agent, or Firm* — Muncy, Giessler, Olds & Lowe, P.C.

(57) ABSTRACT

An electrical power connector preparation method including employing a cold drawing technique to draw a metal round rod into a thin thickness conducting contact bar, stamping the thin thickness conducting contact bar to form a mating contact portion and a mounting portion, attaching the thin thickness conducting contact bar to a contact material strip, cutting off the thin thickness conducting contact bar, repeating the aforesaid steps to obtain a large amount of metal contacts at the contact material strip and then shaping the metal contacts, removing the shaped metal contacts from the contact materials trip and electroplating the shaped metal contacts, and then using an insert molding technique to mold electrically insulative terminal blocks on metal contacts so as to obtain electrical power connectors directly, or assembling electrically insulative terminal block and the respective metal contacts with one respective electrically insulative housing to form a respective electrical power connector.

14 Claims, 13 Drawing Sheets

ELECTRICAL POWER CONNECTOR PREPARATION METHOD

BACKGROUND OF THE INVENTION

1. Field of the Invention

The present invention relates to electrical connector technology and more particularly, to an electrical power connector preparation method, which employs a cold drawing procedure to draw a metal round rod into a conducting contact bar, stamping and cutting and electroplating techniques to process conducting contact bar into metal contacts, and an insert molding technique to mold electrically insulative terminal blocks on metal contacts, thereby obtaining a large number of electrical power connectors rapidly and economically.

2. Description of the Related Art

Power sockets are widely used in electric and electronic devices, such as portable audio, audio and video players (CD, VCD, DVD players), computer, notebook computer, mobile phone and other information products for connection to a city power outlet for power input so that the electric and electronic devices can obtain the necessary working power supply and can be operated by a user.

A power socket has at least one metal contact that can be made in a solid or hollow form. A hollow metal contact, as shown in FIG. 12, is made by: using a stamping technique to stamp a metal sheet material, for example, copper sheet material, into a predetermined shape, and then bending the shaped copper sheet material into a cylindrical configuration having a rounded contact portion A at its one end and a flat mounting portion B at its other end. Because this design of hollow metal contact is made by curving a shaped copper sheet material into a cylindrical configuration without riveting, the applied force must be properly controlled when curving the shaped copper sheet material. If the applied force is excessively high or insufficient, the two opposite side edges of the shaped copper sheet material may not be positively and accurately abutted against each other after formation of the metal contact, lowering the product yield rate. Further, a hollow metal contact has a relatively lower structural strength, and can easily be deformed or damaged upon connection between the power socket and a mating electrical connector. Further, when curving a shaped copper sheet material into a cylindrical configuration, a seam line will be left at the front side of the hollow metal contact, affecting the sense of beauty of the outer appearance of the hollow metal contact.

Further, a power socket using solid contacts is known, as shown in FIG. 13, comprising an electrically insulative housing C, and a first solid contact D and a second solid contact E mounted in the electrically insulative housing C. The first solid contact D has a locating flange D1 extending around the periphery thereof and positioned in a front side of a back wall of the electrically insulative housing C and a rear mounting end D2 extended out of the back wall of the electrically insulative housing C. The second solid contact E is riveted to the rear mounting end D2 of the first solid contact D. Further, the first solid contact D is made of a metal material using a milling technique. However, because the locating flange D1 has a relatively larger outer diameter than the first solid contact D, the metal material used for making the first solid contact pin D must have a diameter not less than the outer diameter of the locating flange D1. Thus, about 40% of the metal material is wasted, increasing the material cost. Moreover, further waste recycling is necessary to recycle waste metal material. Further, because the first solid contact D and the second solid contact E are riveted together, they may be loosened from each other after a long use. If the first solid contact D and the second solid contact E are loosened, a large electrical resistance may be produced during transmission of electricity, leading to the problems of high temperature, poor contact, electric shock or connector dropping and severely affecting application safety.

Thus, the fabrication of electrical power connectors using either solid or hollow metal contacts according to the prior art methods has the drawbacks of low metal contact structural strength, low product yield rate, large amount of waste material, requirement of an extra waste material recycling treatment, and high manufacturing cost.

Therefore, it is desirable to provide a method for making metal contacts and electrical power connectors that eliminates the aforesaid problems.

SUMMARY OF THE INVENTION

The present invention has been accomplished under the circumstances in view. It is therefore the main object of the present invention to provide an electrical power connector preparation method, which significantly improves the electrical power connector fabrication efficiency, shortens the electrical power connector fabrication time, increases the electrical power connector yield rate, and reduces the electrical power connector manufacturing cost.

To achieve this and other objects of the present invention an electrical power connector preparation method in accordance with the present invention comprises the steps of: employing a cold drawing technique with the use of a series of dies having different diameters of drawing holes to repeatedly draw a metal round rod into a thin thickness conducting contact bar, stamping one end of the thin thickness conducting contact bar into a mating contact portion, stamping a part of the thin thickness conducting contact adjacent to the mating contact portion to form a mounting portion, attaching the thin thickness conducting contact to one of a plurality of locating notches of a contact material strip, cutting off the thin thickness conducting contact to obtain a finished metal contact comprising the mating contact portion and the mounting portion, repeating the aforesaid steps to obtain a large amount of metal contacts and to have the metal contacts be positioned in respective locating notches of the contact material strip, processing the metal contacts at the contact material strip into shaped metal contacts, and then removing the shaped metal contacts from the contact material strip, electroplating the shaped metal contacts, arranging the electroplated shaped metal contacts into multiple sets of electroplated shaped metal contacts and inserting each set of electroplated shaped metal contacts into one respective cavity of a molding mold, and then using an insert molding technique to mold one respective electrically insulative terminal block on each set of electroplated shaped metal contacts. Subject to this preparation method, a large number of high structural strength metal contacts can be rapidly made and a large number of electrical power connectors can be rapidly assembled, shortening electrical power connector manufacturing time, improving the electrical power connector manufacturing efficiency, and saving the electrical power connector manufacturing cost.

Further, because the procedure of electroplating the metal contacts is performed after removal of the shaped metal contacts from the contact material strip, the shaped metal contacts can be well plated, avoiding interference of the contact material strip during electroplating and eliminating plating defects. Moreover, since the metal contacts 3 are shaped before electroplating, cracking or peeling off of the coating on the metal contacts 3 that may happen at shaping is avoided.

Further, because the shaped metal contacts are removed from the contact material strip prior to electroplating, barrel plating can be employed to plate the shaped metal contacts.

Further, a shoulder is formed on each shaped metal contact between the mating contact portion and the mounting portion during the performance of the stamping technique. After molding of one electrically insulative terminal block on one respective set of electroplated shaped metal contacts, the shoulders of metal contacts are embedded in the respective electrically insulative terminal block, and thus, the electroplated shaped metal contacts and the respective electrically insulative terminal block are tightly secured together. The electroplated shaped metal contacts and the associating electrically insulative terminal block can then be assembled with an respective electrically insulative housing to force respective retaining protrusions and locating grooves of the electrically insulative terminal block into engagement with respective retaining grooves and locating blocks of the respective electrically insulative housing, thereby forming an electrical power connector having the characteristics of high stability, high reliability and long lifespan.

DETAILED DESCRIPTION OF THE PREFERRED EMBODIMENT

Figure 1:
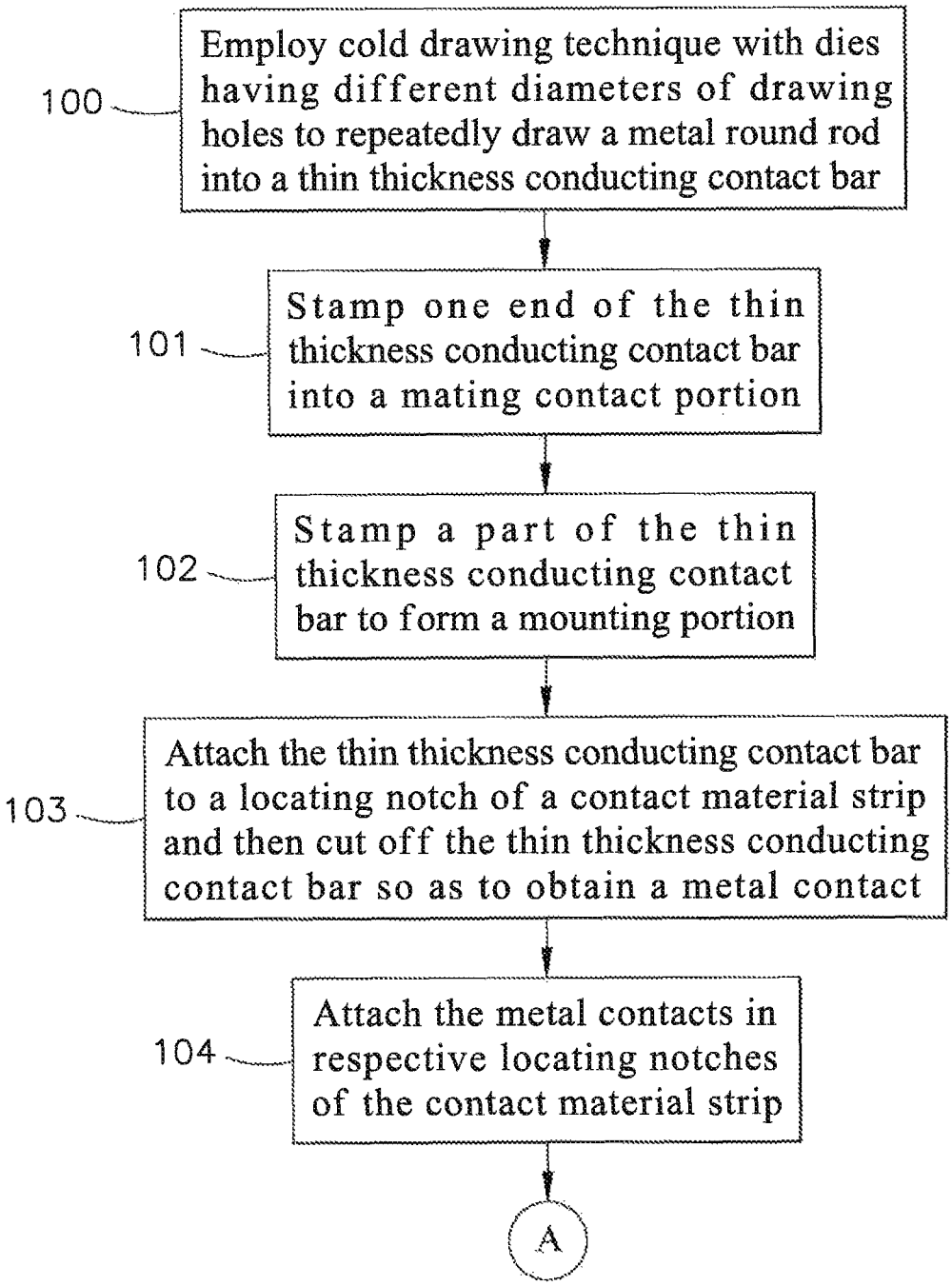
FIG. 1 is a flow chart of an electrical power connector preparation method in accordance with the present invention (I).
Figure 2:
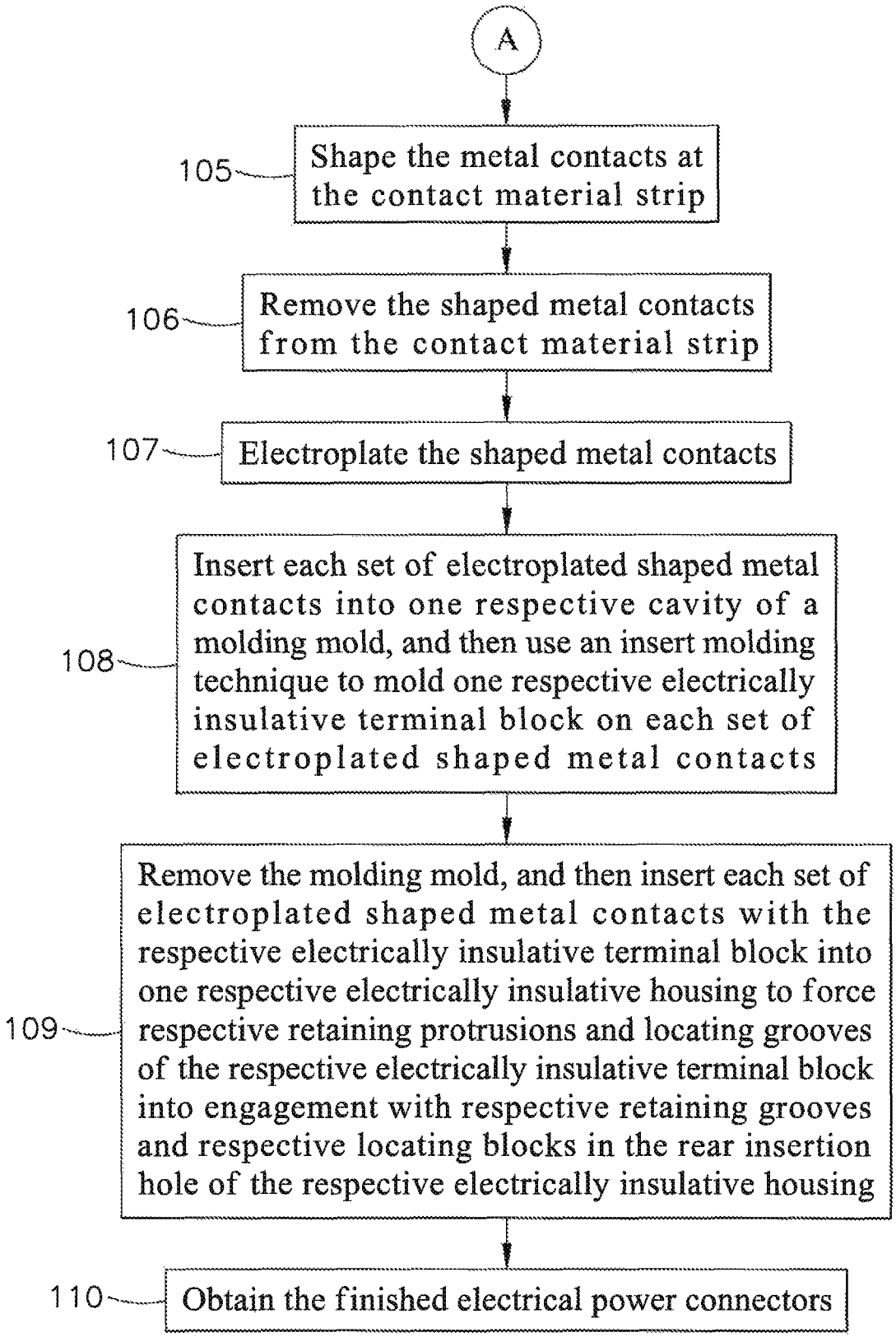
FIG. 2 is a flow chart of the electrical power connector preparation method in accordance with the present invention (II).
Figure 3:
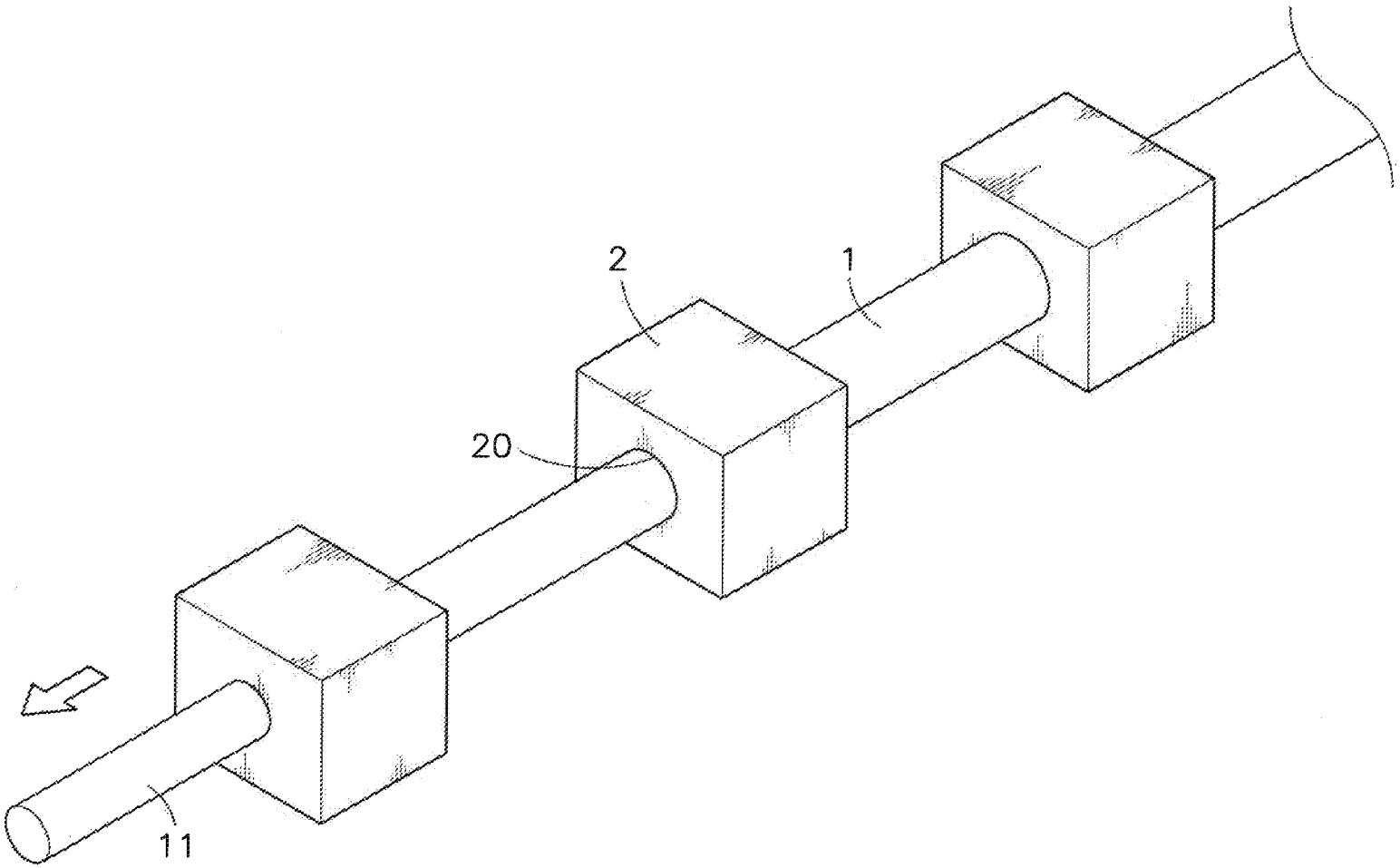
FIG. 3 is a schematic drawing illustrating the performance of a cold drawing step of the electrical power connector preparation method in accordance with the present invention.
Figure 4:
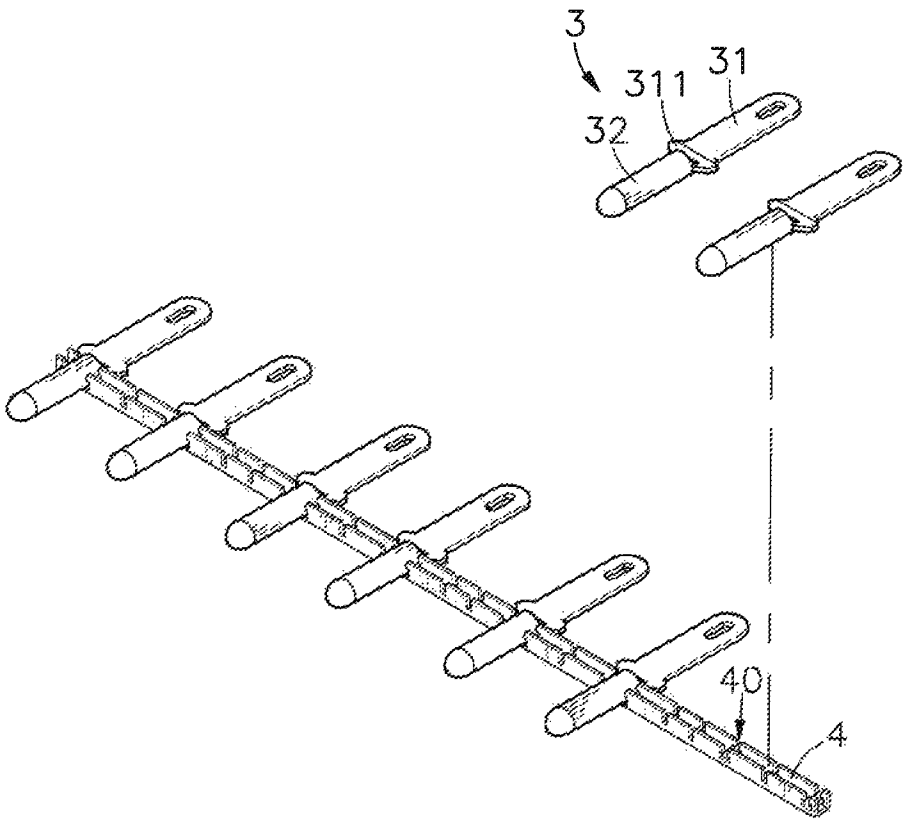
FIG. 4 is a schematic drawing illustrating installation of metal contacts in a contact material strip during the application of the electrical power connector preparation method in accordance with the present invention.
Figure 5:
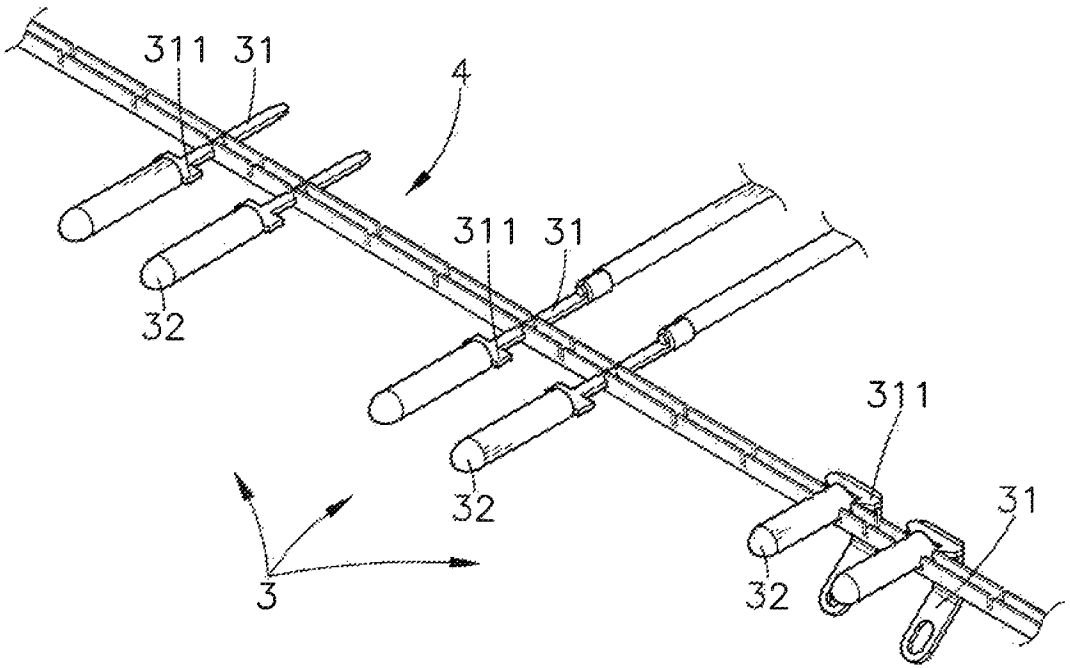
FIG. 5 is a schematic drawing illustrating shaped metal contacts positioned in the contact material strip and electrical wires connected to the mounting portions of the shaped metal contacts in accordance with the present invention.
Figure 6:
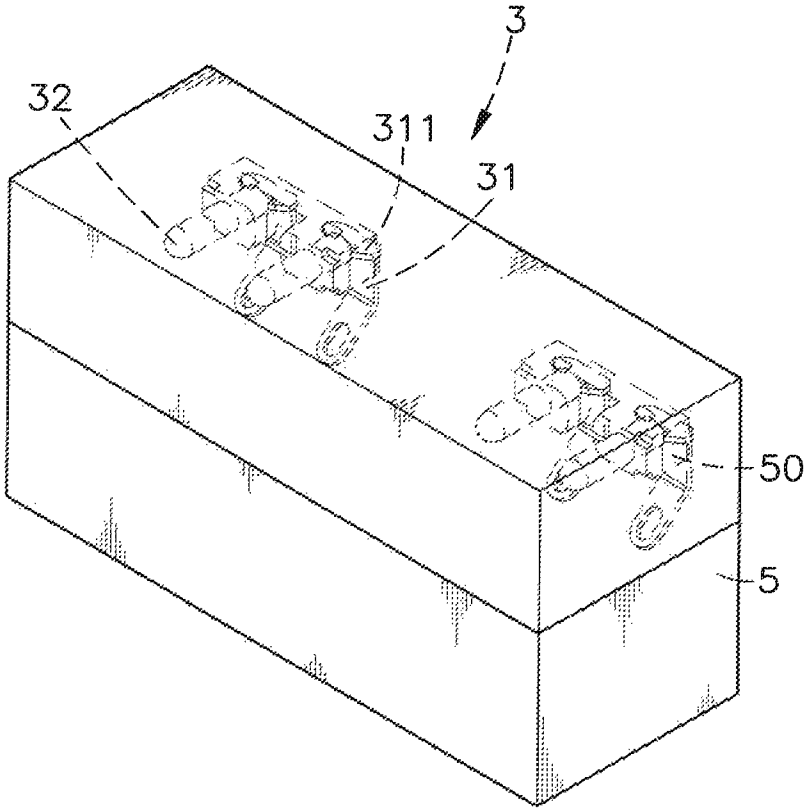
FIG. 6 is a schematic drawing illustrating electroplated shaped metal contacts arranged in sets and inserted into respective cavities of a mold during the application of the electrical power connector preparation method in accordance with the present invention.
Figure 7:
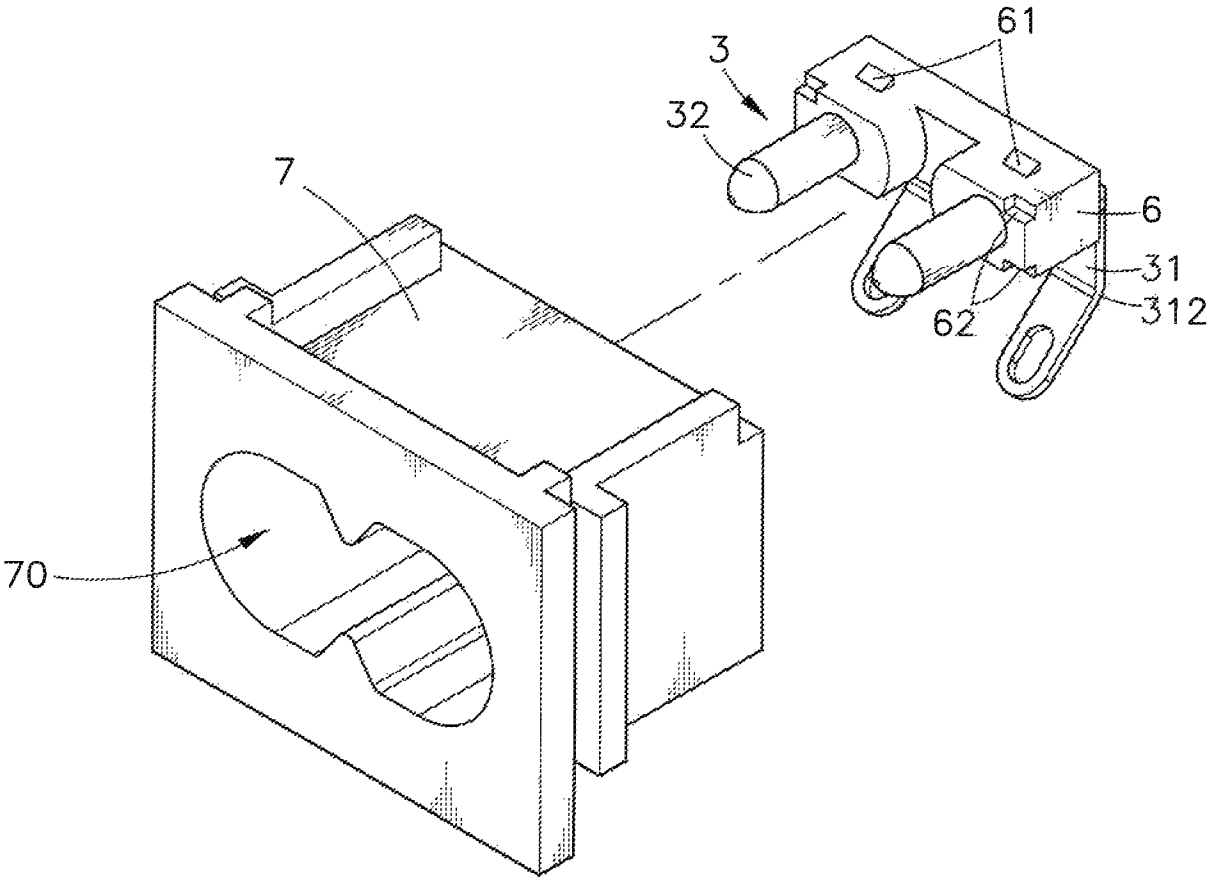
FIG. 7 illustrates an electrically insulative terminal block molded on two electroplated shaped metal contacts before installation in an electrically insulative housing in accordance with the present invention.
Figure 8:
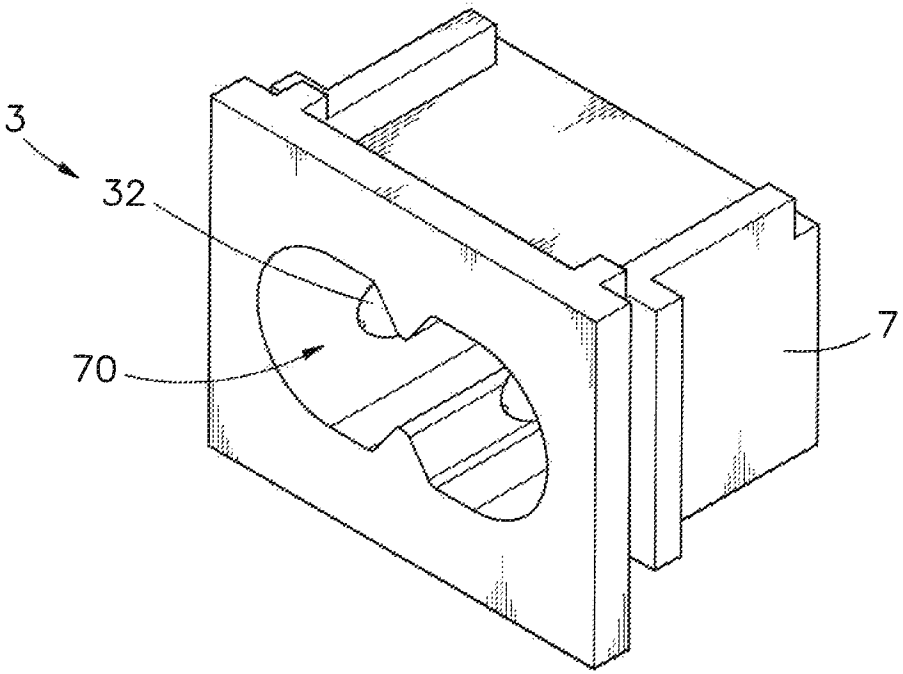
FIG. 8 is an assembly view of FIG. 7.
Figure 9:
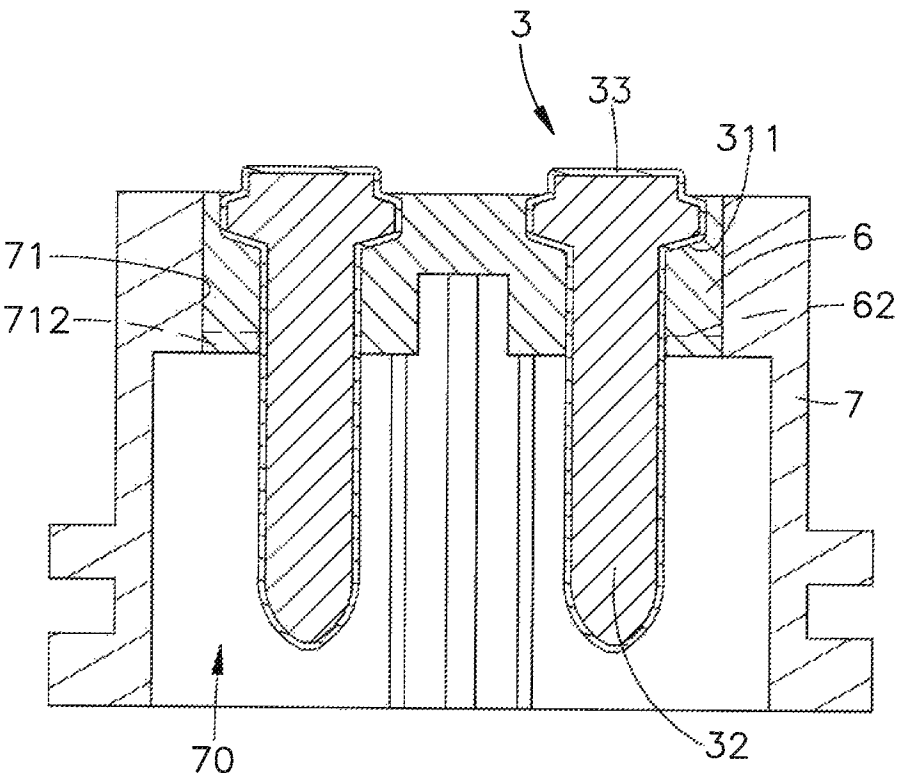
FIG. 9 is a sectional top view, in an enlarged scale, of FIG. 8.
Figure 10:
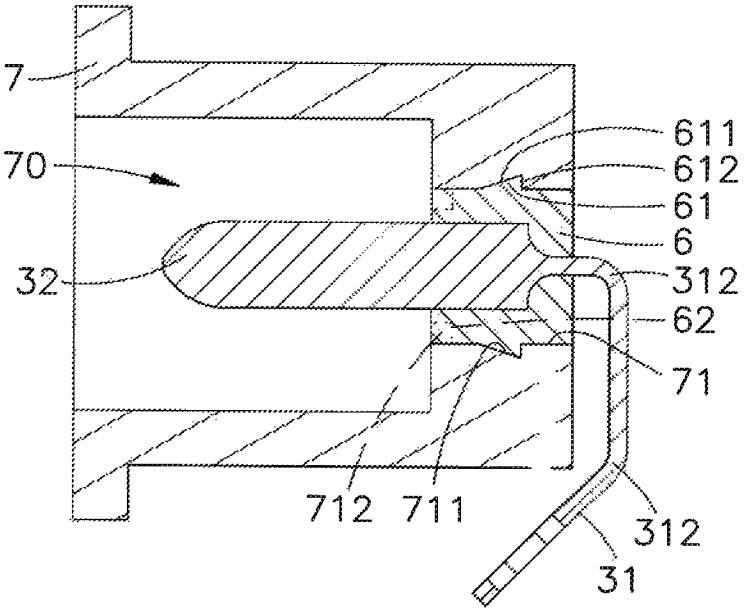
FIG. 10 is a sectional side view of FIG. 8.

Referring to FIGS. 1-10, an electrical power connector preparation method in accordance with the present invention is shown, comprising the steps of:

(100) employing a cold drawing technique with a series of dies 2 having different diameters of drawing holes 20 to repeatedly draw a metal round rod 1, for example, copper or copper alloy round rod, into a thin thickness conducting contact bar 11;

(101) stamping one end of the thin thickness conducting contact bar 11 into a mating contact portion 32;

(102) stamping a part of the thin thickness conducting contact bar 11 to form a mounting portion 31 at a predetermined distance from the mating contact portion 32;

(103) attaching a part of the mounting portion 31 of the thin thickness conducting contact bar 11 to a locating notch 40 of a contact material strip 4, and then cutting off the thin thickness conducting contact bar 11 so that a finished metal contact 3 formed of the mounting portion 31 and the mating contact portion 32 is provided;

(104) attaching a plurality of metal contacts 3 in respective locating notches 40 of the contact material strip 4;

(105) shaping the metal contacts 3 at the contact material strip 4;

(106) removing the shaped metal contacts 3 from the contact material strip 4;

(107) electroplating the shaped metal contacts 3 to form an coating 33 on the surface of each shaped metal contact 3 (see FIG. 9);

(108) inserting the mating contact portions 32 of each two shaped metal contacts 3 into one respective cavity 50 of a molding mold 5, and then using an insert molding technique to mold an electrically insulative terminal block 6 on each two shaped metal contacts 3;

(109) removing the molding mold 5, and then inserting each two shaped metal contacts 3 with the respective electrically insulative terminal block 6 through a rear insertion hole 71 of one respective electrically insulative housing 7 into a front receiving chamber 70 of the respective electrically insulative housing 7 to force respective retaining protrusions 61 and locating grooves 62 of the respective electrically insulative terminal block 6 into engagement with respective retaining grooves 711 and respective locating blocks 712 in the rear insertion hole 71 of the respective electrically insulative housing 7; and (110) obtaining the desired electrical power connector.

Further, the mounting portion 31 of each metal contact 3 has a flat shape configured for wire bond, wire clamp or DIP (dual inline package) application. Further, the mating contact portion 32 can be shaped like a round head cylinder. Further, when stamping a part of the thin thickness conducting contact bar 11 into a mounting portion 31, a shoulder 311 can be simultaneously formed on the thin thickness conducting contact bar 11 between the mounting portion 31 and the associating mating contact portion 32. Alternatively, each metal contact 3 can be shaped to provide the shoulder 311 after formation of the mounting portion 31 and the mating contact portion 32.

Further, the contact material strip 4 has a U-shaped cross section with locating notches 40 located at the two parallel upright sidewalls of the U-shaped cross section. Further, after metal contacts 3 are shaped, they are removed from the locating notches 40 of the contact material strip 4, and then these shaped metal contacts 3 are electroplated partially or locally using a dip electroplating, barrel plating or brush electroplating technique. Further, the molding mold 5 used in the aforesaid electrical power connector preparation procedure can be designed to provide one or a number of cavities 50 so that one or a number of electrically insulative terminal blocks 6 can be molded on each two shaped metal contacts 3 by means of insert molding. Subject to the design of the shoulder 311 of each metal contact 3, the bonding tightness between each electrically insulative terminal block 6 and the associating shaped metal contacts 3 is greatly enhanced, avoiding detachment of the shaped metal contacts 3 from the respective electrically insulative terminal block 6. Further, each retaining protrusion 61 of the electrically insulative terminal block 6 defines a front sloping guide surface 611 and a rear vertical stop surface 612. Further, the locating grooves 62 are respectively located in corners of the front wall of the electrically insulative terminal block 6.

Further, the electrically insulative housing 7 is an independent member separately made, comprising a front receiving chamber 70 defined in the front side thereof, a rear insertion hole 71 defined in the rear side thereof in communication with the front receiving chamber 70, a plurality of retaining grooves 711 located in the inside wall thereof in communication with the rear insertion hole 71, and a plurality of locating blocks 712 respectively disposed in the front side of the rear insertion hole 71 and facing toward the front receiving chamber 70. When inserting each two shaped metal contacts 3 with the respective electrically insulative terminal block 6 though the rear insertion hole 71 of one respective electrically insulative housing 7 into the front receiving chamber 70 of the respective electrically insulative housing 7, the front sloping guide surfaces 611 of the retaining protrusions 61 of the electrically insulative terminal block 6 can guide the respective retaining protrusions 61 into the respective retaining grooves 711 in the rear insertion hole 71. After the retaining protrusions 61 entered the respective retaining grooves 711, the rear vertical stop surfaces 612 of the retaining protrusions 61 are respectively stopped against respective back walls of the respective retaining grooves 711 to prohibit the electrically insulative terminal block 6 from backward displacement relative to the respective electrically insulative housing 7, and the locating grooves 62 of the electrically insulative terminal block 6 are respectively kept in engagement with the respective locating blocks 712 in the rear insertion hole 71 of the electrically insulative housing 7. At this time, the mating contact portions 32 of the two shaped metal contacts 3 are kept suspending in the front receiving chamber 70 of the electrically insulative housing 7.

Subject to the use of one contact material strip 4 to hold multiple metal contacts 3 at a predetermined interval either by manual operation or by means of an automatic or semiautomatic equipment, multiple metal contacts 3 can be simultaneously moved and accurately shaped to, for example, process the mounting portion 31 of each metal contact 3 into two curved portions 312. Then, the shaped metal contacts 3 are removed from the contact material strip 4 and electroplated. Subsequently, the metal contacts 3 are inserted into respective cavities 50 in one or multiple cavities of molding molds 5, and thus, multiple electrically insulative terminal blocks 6 can be simultaneously molded on respective sets of shaped metal contacts 3 by means of insert molding at a time, improving the electrical power connector manufacturing efficiency, shortening the electrical power connector manufacturing time and increasing the electrical power connector manufacturing yield rate. Further, as stated above, the design of the shoulder 311 of each metal contact 3 enables the bonding tightness between each electrically insulative terminal block 6 and the associating shaped metal contacts 3 to be greatly enhanced. Further, subject to engagement between the retaining protrusions 61 and locating grooves 62 of the electrically insulative terminal block 6 and the retaining grooves 711 and locating blocks 712 of the electrically insulative housing 7, the respective shaped metal contacts 3 are positively held in the front receiving chamber 70 of the electrically insulative housing 7 for positive contact with respective mating metal contacts of a male mating electrical power connector, prolonging the lifespan of the electrical power connector.

Further, by means of repeating steps (101)~(103), a large amount (50 pcs, 100 pcs, 150 pcs, 200 pcs or more) of shaped metal contacts 3 can be prepared within a short period of time. After preparation of a large amount of shaped metal contacts 3, steps (104)~(109) are performed with the use of the molding mold 5, and thus a large amount of electrical power connectors can be rapidly made.

Figure 11:
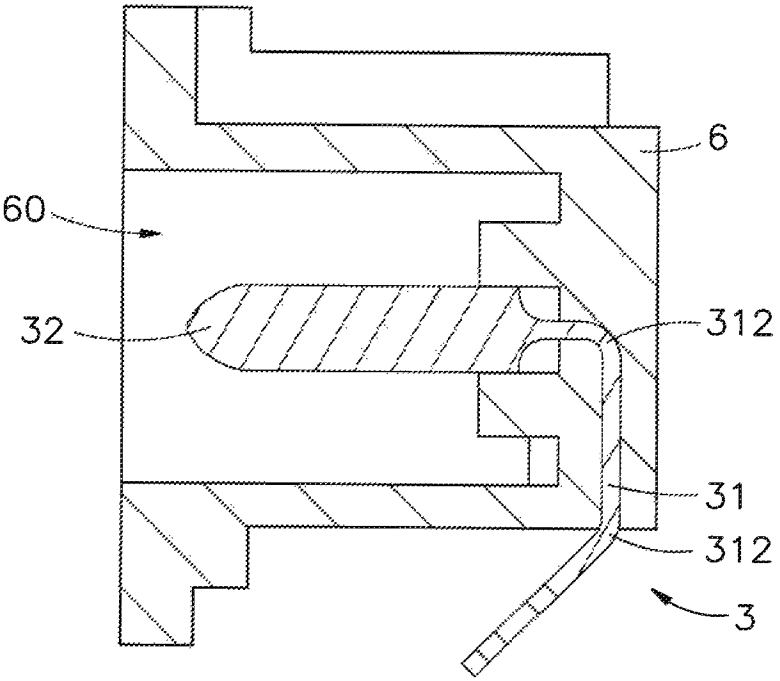
FIG. 11 is a sectional side view of an alternate form of the electrical power connector made in accordance with the present invention.
Figure 12:
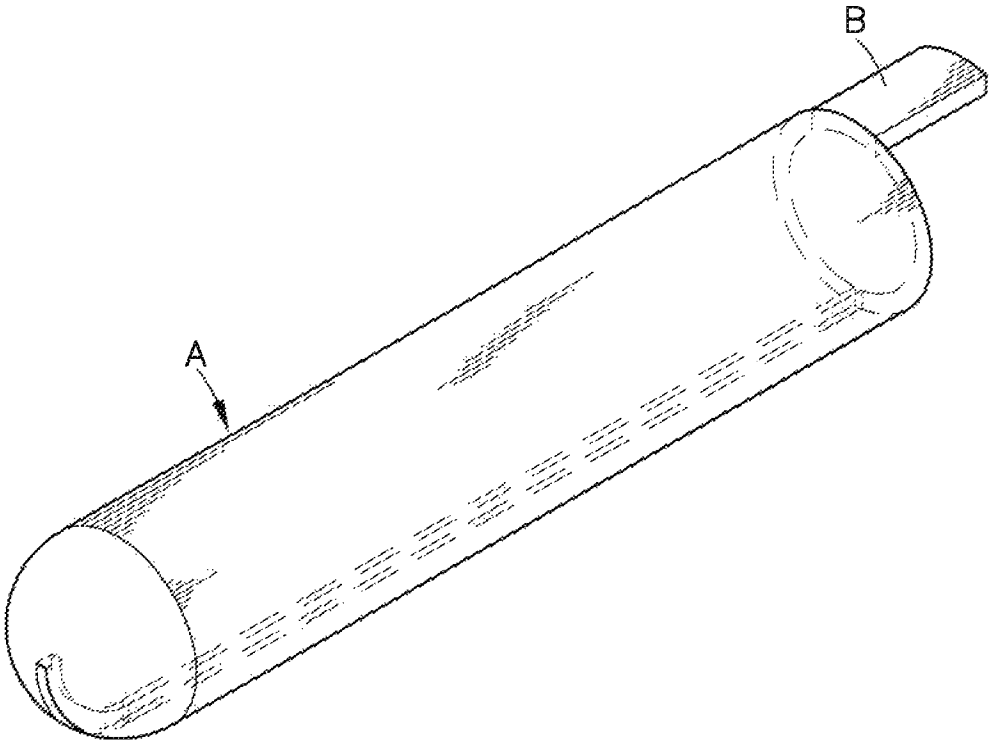
PRIOR ART FIG. 12
FIG. 12 is a schematic perspective view of a metal contact for electrical power connector according to the prior art.
Figure 13:
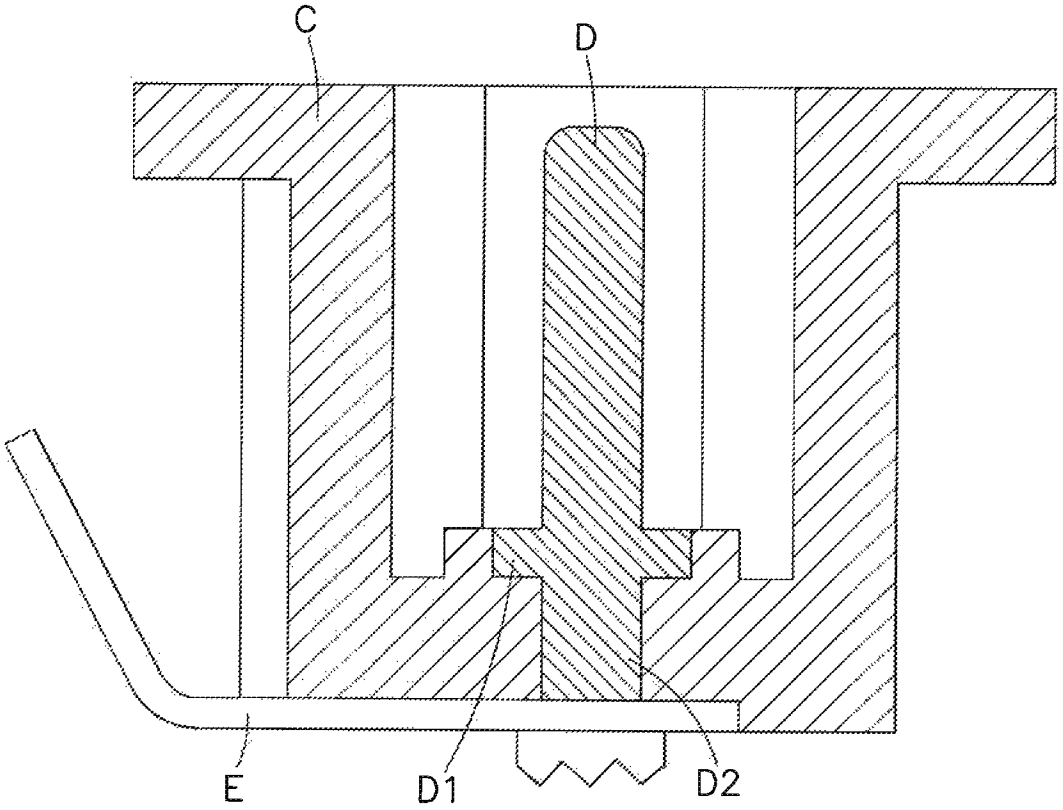
PRIOR ART FIG. 13
FIG. 13 is a sectional side view of an electrical power connector according to the prior art.

Referring to FIG. 11 and FIGS. 1-6 again, an alternate form of the electrical power connector preparation method in accordance with the present invention is shown. After employing a cold drawing technique to draw a metal round rod 1 into a thin thickness conducting contact bar 11 using a series of dies 2 having different diameters of drawing holes 20, stamp one end of the prepared thin thickness conducting contact bar 11 into a round head cylinder-like mating contact portion 32, and then stamp a part of the thin thickness conducting contact bar 11 to form a flat mounting portion 31 for the bonding of an electrical wire. Alternatively, the mounting portion 31 can be configured having a substantially I-shaped, U-shaped or T-shaped front end connected to the round head cylinder-like mating contact portion 32 and a substantially U-shaped or plug pin-like rear end for the connection of an electrical wire. Thereafter, an electrically insulative terminal block 6 is molded on each two electroplated shaped metal contacts 3, forming an electrical power connector where the round head cylinder-like mating contact portion 32 of each electroplated shaped metal contact 3 partially suspends in a front receiving chamber 60 of the electrically insulative terminal block 6, and the mounting portion 31 of each electroplated shaped metal contact 3 partially suspends outside the electrically insulative terminal block 6.

Further, one electrically insulative terminal block 6 can be molded on each two electroplated shaped metal contacts 3, and then assembled with one respective electrically insulative housing 7 to form one respective DIP (dual inline package) type electrical power connector. Further, three shaped metal contacts 3 can be arranged in a triangular relationship and inverted into one respective cavity 50 of a molding mold 5, and then mold one respective electrically insulative terminal block 6 on three shaped metal contacts 3 in each cavity 50 of the molding mold 5. After removal of each molded electrically insulative terminal block 6 with the respective three shaped metal contacts 3 from the molding mold 5, the electrically insulative terminal block 6 is inserted with the respective three shaped metal contacts 3 into one respective electrically insulative housing 7 to form a 3-pin electrical power connector.

Further, the whole round head cylinder-like mating contact portion 32 of each of two shaped metal contacts 3 and a part of the flat mounting portion 31 of each of the two shaped metal contacts 3 can be inserted into one cavity 50 in one molding mold 5, enabling an electrically insulative terminal block 6 to be directly molded on the shaped metal contacts 3 by means of insert molding to form a simple structure of electrical power connector, saving the aforesaid step (109). Alternatively, the mounting portion 31 of each of two shaped metal contacts 3 can be connected with one respective electrical wire prior to insertion of the two shaped metal contacts 3 into one cavity 50 in one molding mold 5 for molding an electrically insulative terminal block 6 thereon.

Further, an electrical power connector made in accordance with the present invention can be installed in an electrical home appliance for the connection of a mating power cable for power input.

Referring to FIGS. 1, 2, 4 and 5 again, after formation of the mounting portion 31 of each metal contact 3 and positioning of metal contacts 3 in respective locating notches 40 of the contact material strip 4 in step (104), step (105) is performed to shape the metal contacts 3, for example, to process the mounting portion 31 of each metal contact 3 into two curved portions, i.e., a first curved portion 312 disposed close to the electrically insulative terminal block 6 and defining a 90-degrees contained angle, and a second curved portion 312 disposed remote from the electrically insulative terminal block 6 and defining a contained angle over 90 degrees. Further, after removal of the shaped metal contacts 3 from the contact material strip 4, these shaped metal contacts 3 are electroplated. Because the metal contact shaping step is performed after removal of the shaped metal contacts 3 from the contact material strip 4, the shaped metal contacts 3 can be well plated, avoiding interference of the contact material strip 4 during electroplating and eliminating plating defects. Moreover, since the metal contacts 3 are shaped before electroplating, cracking or peeling off of the coating on the metal contacts 3 that may happen at shaping is avoided. Further, because the shaped metal contacts 3 are removed from the contact material strip 4 prior to electroplating, barrel plating can be employed to plate the shaped metal contacts 3.

As stated above, the invention provides an electrical power connector preparation method for making electrical power connectors by: employing a cold drawing technique with the use of a series of dies 2 having different diameters of drawing holes 20 to repeatedly draw a metal round rod 1 into a thin thickness conducting contact bar 11, processing one end of the thin thickness conducting contact bar 11 into a mating contact portion 32, stamping a part of the thin thickness conducting contact 11 to form a mounting portion 31, cutting off the thin thickness conducting contact bar 11 so that a finished metal contact 3 formed of the mounting portion 31 and the mating contact portion 32 is obtained, repeating the aforesaid steps to obtain a large amount of metal contacts 3, attaching individual metal contacts 3 to respective locating notches 40 of a contact material strip 4, shaping the metal contacts 3 at the contact material strip 4, removing the shaped metal contacts 3 from the contact material strip 4, electroplating the shaped metal contacts 3, using an insert molding technique and a molding mold 5 to mold an electrically insulative terminal block 6 on each two or three shaped and electroplated metal contacts 3, and then assembling each electrical insulative terminal block 6 and the respective metal contacts 3 with one respective electrical insulative housing 7 to form one respective electrical power connectors. This method facilitates quick preparation of a large amount of electrical power connectors.

In conclusion, the invention provides an electrical power connector preparation method for making electrical power connectors, which has the advantages and features as follows:

1. The invention can obtain a large amount of high strength metal contacts 3 rapidly and economically without producing much waste material by: employing a cold drawing technique with a series of dies 2 having different diameters of drawing holes 20 to repeatedly draw a metal round rod 1 into a thin thickness conducting contact bar 11, processing one end of the thin thickness conducting contact bar 11 into a mating contact portion 32 and stamping a part of the thin thickness conducting contact bar 11 to form a mounting portion 31, attaching the processed thin thickness conducting contact bar 11 to one respective locating notch 40 of a contact material strip 4, and then cutting off the thin thickness conducting contact bar 11, and then repeating the aforesaid steps.
2. After a predetermined number of metal contacts 3 have been made and attached to respective locating notches 40 of the contact material strip 4, a shaping step is employed to shape each metal contact 3, and then the shaped metal contacts 3 are removed from the contact material strip 4 and then electroplated using a dip electroplating, barrel plating or brush electroplating technique, facilitating electroplating and assuring a high level of plating quality.
3. When a metal contact 3 is prepared, a shoulder 311 is formed between the mounting portion 31 and the mating contact portion 32. After molding of an electrically insulative terminal block 6 on one set of electroplated shaped metal contacts 3 using a molding mold 5, the shoulders 311 of the set of electroplated shaped metal contacts 3 are embedded in the electrically insulative terminal block 6, and the electroplated shaped metal contacts 3 with the associating electrically insulative terminal block 6 can then be assembled with an electrically insulative housing 7 to force the retaining protrusions 61 and locating grooves 62 of the electrically insulative terminal block 6 into engagement with the retaining grooves 711 and locating blocks 712 of the electrically insulative housing 7, thereby forming an electrical power connector having the characteristics of high stability, high reliability and long lifespan.
4. By using an automatic equipment or manual equipment to attach a large amount of metal contacts 3 in the locating notches 40 of the contact material strips 4, the metal contacts 3 at a contact material strip 4 can be moved to appropriate positions to proceed shaping, facilitating mass production of metal contacts, and therefore, the invention greatly shortens electrical power connector manufacturing time and significantly improves electrical power connector manufacturing efficiency.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An electrical power connector preparation method, comprising the steps of:

(a01) employing a cold drawing technique to draw a metal round rod into a thin thickness conducting contact bar;

(a02) stamping one end of said thin thickness conducting contact bar into a mating contact portion;

(a03) stamping a part of said thin thickness conducting contact adjacent to said mating contact portion to form a mounting portion;

(a04) attaching said thin thickness conducting contact to one of a plurality of locating notches of a contact material strip and then cutting off said thin thickness conducting contact to obtain a finished metal contact comprising said mating contact portion and said mounting portion;

(a05) attaching a plurality of said metal contacts in respective locating notches of said contact material strip;

(a06) processing said metal contacts at said contact material strip into shaped metal contacts;

(a07) removing said shaped metal contacts from said contact material strip;

(a08) electroplating said shaped metal contacts; and (a09) arranging said electroplated shaped metal contacts into multiple sets of electroplated shaped metal contacts and inserting each said set of electroplated shaped metal contacts into one respective cavity of a molding mold, and then using an insert molding technique to mold one respective electrically insulative terminal block on each said set of electroplated shaped metal contacts.

2. The electrical connector preparation method as claimed in claim 1, wherein said metal round rod is selected from the material group of copper and copper alloys.

3. The electrical connector preparation method as claimed in claim 1, wherein said mounting portion made during step (a03) is configured for one of wire bond, wire clamp and DIP (dual inline package) applications.

4. The electrical connector preparation method as claimed in claim 3, wherein a shoulder is formed on said thin thickness conducting contact between said contact portion and said mounting portion when stamping a part of said thin thickness conducting contact to form said mounting portion during step (a03).

5. The electrical connector preparation method as claimed in claim 1, further comprising a sub step of repeating steps (a02)~(a04) before step (a05) for obtaining a large amount of said metal contacts, and steps (a05)~(a09) are performed after preparation of the desired amount of said metal contacts.

6. The electrical connector preparation method as claimed in claim 1, further comprising a sub step of electrically connecting one respective electrical wire to the mounting portion of each said shaped metal contact after step (a08) and before step (a09).

7. The electrical connector preparation method as claimed in claim 1, wherein said contact material strip used during step (a04) has a U-shaped cross section, and each said locating notch of said contact material strip is located at two parallel upright sidewalls of said U-shaped cross section.

8. The electrical connector preparation method as claimed in claim 1, wherein during step (a09), each three said electroplated shaped metal contacts are arranged in a set in a triangular relationship and then inserted into one respective cavity of said molding mold, and then an insert molding technique is performed to mold one respective electrically insulative terminal block on each said set of electroplated shaped metal contacts to form a 3-pin electrical power connector.

9. The electrical connector preparation method as claimed in claim 1, wherein during step (a09), each two said electroplated shaped metal contacts are arranged in a set and inserted into one respective cavity of said molding mold, and then an insert molding technique is performed to mold one respective electrically insulative terminal block on each said set of electroplated shaped metal contacts to form a respective 2-pin electrical power connector, and when assembling the electrically insulative terminal block to an rear insertion hole of an electrically insulative housing, the mating contact portions of the respective said set of electroplated shaped metal contacts suspend in a front receiving chamber of said electrically insulative housing and the mounting portions of the respective said set of electroplated shaped metal contacts suspending outside the said electrically insulative housing.

10. The electrical connector preparation method as claimed in claim 1, further comprising step (a10), after step (a09), removing each said electrically insulative terminal block with the respective said set of said metal contacts from said molding mold and then assembling each said electrically insulative terminal block and the respective said set of said metal contacts with one respective electrically insulative housing to form one respective electrical power connector.

11. The electrical connector preparation method as claimed in claim 10, wherein one respective said electrically insulative terminal block that is molded on each said set of said metal contacts during step (a09) comprises a plurality of retaining protrusions; each said electrically insulative housing for mounting with one said electrically insulative terminal block during step (a10) comprises a plurality of retaining grooves respectively formed into engagement with the retaining protrusions of one respective said electrically insulative terminal block.

12. The electrical connector preparation method as claimed in claim 11, wherein each said retaining protrusion of each said electrically insulative terminal block defines a front sloping guide surface for guiding the respective said retaining protrusion into engagement with one respective said retaining groove of one respective said electrically insulative housing during step (a09), and a rear vertical stop surface for stopping against a respective back wall of one respective said retaining groove to prohibit the respective said electrically insulative terminal block from backward displacement relative to the respective said electrically insulative housing; wherein each electrically insulative terminal block further comprises a plurality of locating grooves respectively located in corners of a front wall of the electrically insulative terminal block and the electrically insulative housing further comprises a plurality of locating blocks respectively disposed in the front side of the rear insertion hole for engaging with the respective locating grooves of the electrically insulative terminal block.

13. The electrical connector preparation method as claimed in claim 10, wherein during step (a09), each two said electroplated shaped metal contacts are arranged in a set and then inserted into one respective cavity of said molding mold, and then an insert molding technique is performed to mold one respective electrically insulative terminal block on each said set of said electroplated shaped metal contacts, and then each said electrically insulative terminal block is removed from the respective said molding mold and assembled with one respective said electrically insulative housings to form one respective electrical power connector during step (a10) where the mating contact portions of the respective said set of said electroplated shaped metal contacts suspend in a front receiving chamber of the respective said electrically insulative housing and the mounting portions of the respective said set of electroplated shaped metal contacts suspending outside the respective said electrically insulative housing.

14. The electrical connector preparation method as claimed in claim 1, wherein during step (a09), each two said electroplated shaped metal contacts are arranged into one respective set and then inserted into one respective cavity of said molding mold, and then an insert molding technique is employed to mold one respective electrically insulative terminal block on each said set of electroplated shaped metal contacts, and a finished electrical power connector is obtained after removal of each molded electrically insulative terminal block from said mold.

* * * * *